United States Patent [19]

Wells

[11] Patent Number: 4,730,357

[45] Date of Patent: Mar. 15, 1988

[54] BEDDING BOX SPRING

[75] Inventor: Thomas J. Wells, Carthage, Mo.

[73] Assignee: Leggett & Platt, Incorporated, Carthage, Mo.

[21] Appl. No.: 27,153

[22] Filed: Mar. 17, 1987

[51] Int. Cl.[4] ..... A47C 23/02

[52] U.S. Cl. ..... 5/247; 5/255; 5/268; 267/103; 267/107

[58] Field of Search ..... 5/247, 255, 268, 275–277; 267/103, 107

[56] References Cited

U.S. PATENT DOCUMENTS

| | | | |
|---|---|---|---|
| 221,555 | 11/1879 | Henley | 5/268 |
| 232,390 | 9/1880 | Clippinger | 5/268 |
| 2,773,543 | 12/1956 | Sandor . | |
| 3,248,745 | 5/1966 | Gunlock . | |
| 3,487,480 | 1/1970 | Slominski . | |
| 3,574,240 | 4/1971 | Slominski . | |
| 3,574,241 | 4/1971 | Slominski . | |
| 3,722,013 | 3/1973 | Surletta . | |
| 3,755,833 | 9/1973 | Slominski . | |
| 3,825,960 | 7/1974 | Inman et al. . | |
| 3,833,948 | 9/1974 | Surletta et al. . | |
| 3,852,838 | 12/1974 | Slominski et al. . | |
| 3,971,081 | 7/1976 | Poe . | |
| 4,000,531 | 1/1977 | Inman . | |
| 4,012,802 | 3/1977 | Hutchinson et al. . | |
| 4,060,862 | 12/1977 | Kitchen et al. . | |
| 4,068,329 | 1/1978 | Gross et al. . | |
| 4,068,330 | 1/1978 | Rakow et al. . | |
| 4,101,993 | 7/1978 | Yates et al. . | |
| 4,120,058 | 10/1978 | Kitchen et al. . | |
| 4,129,908 | 12/1978 | Wagner . | |
| 4,186,223 | 1/1980 | Hancock . | |
| 4,195,376 | 4/1980 | Kitchen . | |
| 4,218,790 | 8/1980 | Mizelle . | |
| 4,238,861 | 12/1980 | Mizelle . | |
| 4,251,892 | 2/1981 | Hancock . | |
| 4,253,208 | 3/1981 | Hancock . | |
| 4,339,834 | 7/1982 | Mizelle . | |
| 4,371,152 | 2/1983 | Kitchen et al. . | |
| 4,377,279 | 3/1983 | Schulz, Jr. et al. . | |
| 4,398,705 | 8/1983 | Mizelle . | |
| 4,452,438 | 6/1984 | Hancock et al. . | |
| 4,470,584 | 9/1984 | Mizelle . | |
| 4,475,724 | 10/1984 | Hancock . | |
| 4,510,635 | 4/1985 | Woffendin . | |
| 4,548,390 | 10/1985 | Sasaki . | |
| 4,559,654 | 12/1985 | Mizelle . | |
| 4,577,841 | 3/1986 | Hagemeister . | |
| 4,595,180 | 6/1986 | Hagemeister . | |
| 4,595,181 | 6/1986 | Hagemeister . | |
| 4,675,927 | 7/1987 | Mizelle | 5/268 X |

*Primary Examiner*—Alexander Grosz
*Assistant Examiner*—Michael F. Trettel
*Attorney, Agent, or Firm*—Wood, Herron & Evans

[57] ABSTRACT

A bedding mattress support foundation comprises a base frame, a plurality of formed wire springs mounted upon the base frame, and a wire grid mounted atop the formed wire springs. Each formed wire spring comprises a generally S-shaped horizontal load supporting portion and a pair of vertically extending yieldable end portions extending downwardly from opposite ends of the load supporting portion. Two parallel wires of the wire grid are secured to curvilinear portions of the S-shaped horizontal load supporting portion of each spring and three other parallel wires extending perpendicular to the first two parallel wires and rest atop but are unsecured to the S-shaped horizontal load supporting portion of each spring.

19 Claims, 8 Drawing Figures

BEDDING BOX SPRING

This invention relates to bedding foundation structures, and more particularly, to a box spring assembly of the type which utilizes formed, as opposed to coil, springs. Box springs of this general type employ a matrix of formed wire elements attached to a lower base frame and an upper supporting wire grid. The wire grid in turn customarily is covered with padding and upholstery and is used to support an upholstered mattress.

Formed wire springs and box spring assemblies incorporating formed wire springs have been the subject of numerous patents, as for example, U.S. Pat. Nos. 4,555,097 and 4,398,705.

Formed wire springs represent an attempt to reduce the quantity of wire employed in a box spring in order to achieve a given degree of firmness. The tops of such springs are generally located in a horizontal plane and have yieldable end sections or portions extending downwardly from opposite ends of the horizontal top section of the spring. The yieldable end portions of the springs are generally supported upon a horizontal base frame. The tops of the springs are generally square or rectangular in design and functio to support a wire grid mounted atop the top portions of the springs. Such square or rectangular top portions of the springs, though, have presented a problem relative to attachment of the springs to the wire grid. Metal clips or hooks formed in the grid are conventionally used to firmly connect the deck to the supporting springs. But, because the top portions of the springs are square or rectangular, there is a tendency for the deck to slip or slide within the clip and thereby move relative to the springs. This slippage creates a lateral floating problem of the deck relative to the base frame. It also creates a noise problem.

Another characteristic of box springs utilizing formed wire springs, wherein the top horizontal load supporting portion of the springs are square or rectangular, is that those square or rectangular springs do not fit well into the large radiused corners of the box springs. Accordingly, it has been prior practice to utilize a round head coil spring or a special corner spring in the corners of box spring assemblies of the type which utilized formed wire spring elements.

It has therefore been one objective of this invention to provide an improved formed wire spring element for use in box spring assemblies which may be tightly clamped or crimped to a wire grid of the spring assembly in such a manner that the spring will not slip or slide within the crimp or clip which secures it to the wire grid.

Still another objective of this invention has been to provide an improved formed wire spring for use in box spring assemblies which fits within a radiused corner of the box spring and which does not require a special or different spring in the corner to properly support the rounded corner of the spring assembly.

These objectives are achieved and this invention is in part predicated upon the concept of a formed wire box spring assembly having a unique formed wire element supporting the wire grid of the box spring from the frame. These unique formed wire springs comprise a generally horizontal load supporting portion and yieldable end portions depending from the ends of the load supporting portion. The load supporting portion of the springs are curvilinear in configuration and formed into a generally S or serpentine shape such that two curved sections of the load supporting portion of each spring may be clipped or otherwise secured to two different wires of the wire grid.

The box spring assembly of this invention comprises a rectangular base frame having a pair of side rails and a pair of end rails. A plurality of cross rails, which are generally parallel to each other and to the end rails, extend between the side rails. The box spring assembly also includes a rectangular welded wire grid that forms a mattress supporting deck positioned above the frame and a plurality of formed wire spring elements that are mounted on the base frame and connected to the welded wire deck or grid so as to yieldably resist downwardly directed bedding loads.

Each of the formed wire springs comprises a unitary wire element having a generally horizontal load supporting portion and yieldable end portions depending from the ends of the load supporting portion, the yieldable end portions of the springs being supported upon the base frame. The load supporting portion of each spring is formed from two curvilinear sections formed into a generally S shape. At least two parallel wires of a first set of spaced parallel wires are secured to curvilinear sections of each of the S-shaped load supporting portions of each of the springs. In the preferred embodiment, three additional spaced parallel wires of a second set of parallel wires, which extend perpendicular to the first set, rest atop but are unsecured to the S-shaped load supporting portion of each spring.

The result of this box spring assembly construction is that it results in an improved box spring wherein the interconnection between the welded wire grid and the box spring elements are not subject to slippage or sliding as a consequence of the interconnection between the curvilinear sections of the formed wire spring elements and the welded wire grid. Consequently, there is no tendency of the top grid to float or slide relative to the springs. Additionally, this interconnection results in a very quiet box spring assembly.

Yet another advantage of this construction of the box spring is that the curvilinear section of the S-shaped load supporting portion of the spring may be fitted into a radiused corner of the box spring without the need for any special springs to accommodate that radiused corner.

Yet another advantage of this box spring construction, and particularly of this configuration of formed wire spring element within the box spring, is that it enables the center distance between the vertical, yieldable end portions of the springs to be varied or changed by simply varying the radius of the S-shaped load supporting portion of the spring without any need for additional metal to be inputted into the spring element to accommodate the change.

These and other objects and advantages of this invention will be more readily apparent from the following description of the drawings in which.

Figure 1:
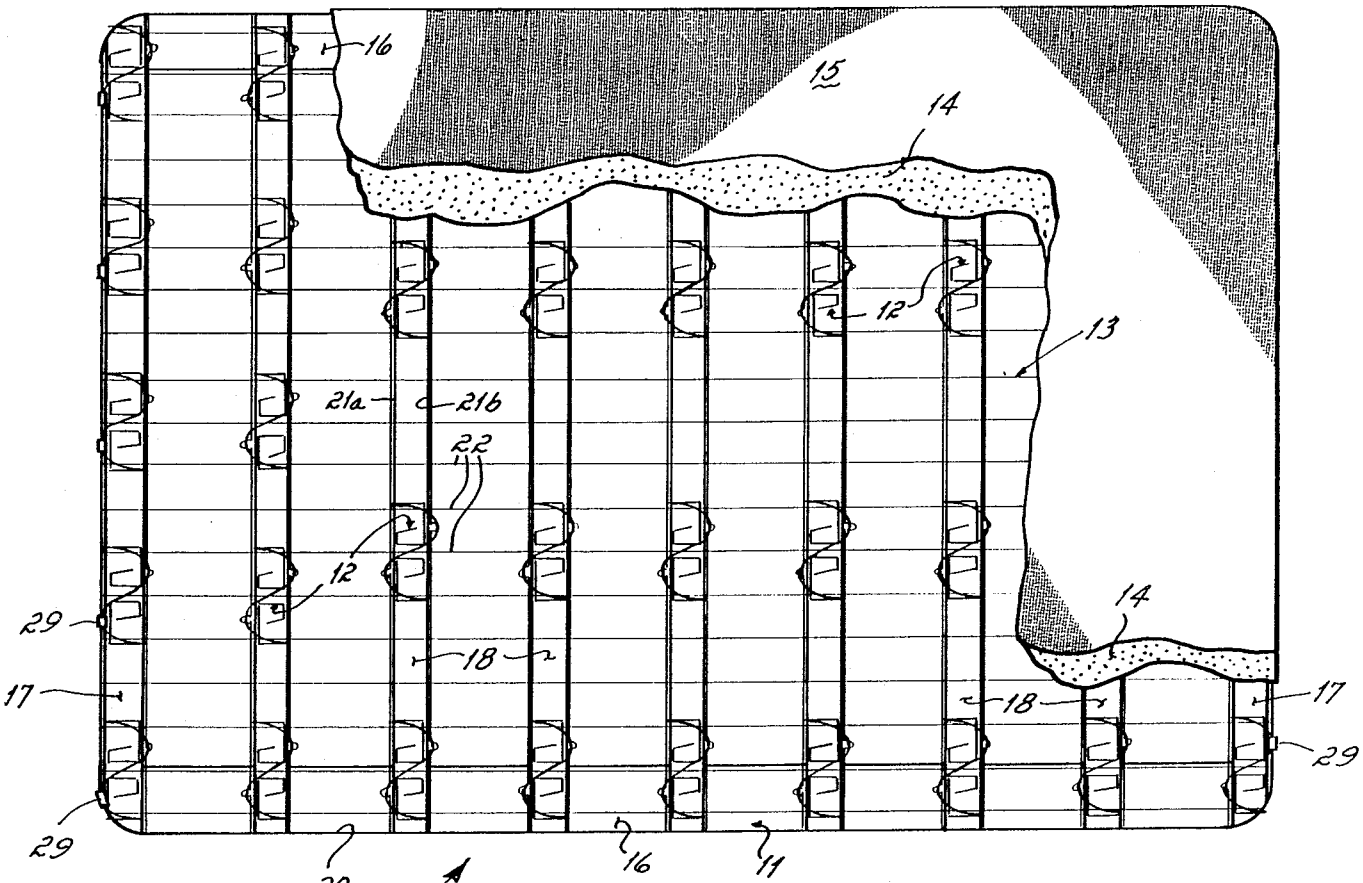
FIG. 1 is a top plan view, partially broken away, of a box spring incorporating the invention of this application.

With reference first to FIG. 1, there is illustrated a box spring 10 incorporating the invention of this application. This box spring 10 is generally rectangular in configuration and comprises a lower wooden base frame assembly 11, a plurality of formed wire spring elements 12, and an upper spring support structure or wire grid 13. The wire grid 13 is covered by padding 14, and the complete assembly, including the base frame 11, spring elements 12, wire grid 13 and padding 14, are all enclosed or encased within a fabric covering 15.

The base frame assembly 11 is illustrated in the preferred embodiment as being a wooden base frame. It could as well, though, be formed with metal rather than wooden transverse slats. The frame includes a pair of side edge boards 16, a pair of end boards 17, and a plurality of regularly spaced cross members or slats 18. The end boards 17 and slats 18 overlie the side boards and are rigidly attached thereto.

Overlying the base frame 11 and lying in a horizontal plane spaced above the base frame assembly 11 is the welded wire grid 13. This grid is generally the same rectangular shape and size as the base frame assembly 11. It comprises a heavy rectangular border wire 20, which is formed in a closed loop about the boundary of the grid directly above and approximately coinciding with the outer edge of the base frame assembly 11. Extending between opposite sides of the border wire 20 are a plurality of grid wires, which include multiple sets or pairs of transverse wires 21*a*, 21*b*, and a multiplicity of longitudinally extending wires 22. The transverse wires 21*a*, 21*b* extend between and are welded or otherwise secured to opposite sides of the border wire 20. The longitudinal wires 22 are similarly welded or otherwise fastened to opposite ends of the border wire 20. In the preferred embodiment, the intersections of the transverse and longitudinal grid wires are welded together. Together, the longitudinal wires and transverse wires define a matrix or array of pockets in the rectangular grid.

The padding 14 overlies the grid 13. The upper extent of the box spring assembly is covered by the upholstery 15 which is stretched over the pad and usually fastened by staples or similar attaching elements to the underside of the wooden base frame assembly 11.

Supporting the welded wire grid 13 above the base frame assembly 11 is a plurality of formed wire springs 12. The springs are vertically oriented and are spaced in an array between the base frame assembly 11 and the grid 13. Each of the springs 12 occupies a single position or pair of grid pockets in the array. These springs 12 are attached at their upper ends to the grid 13. The springs are attached at their lower ends to the end boards or transverse slats of the base frame assembly 11. In such an arrangement, the springs provide distributed elastic support for the grid 13 and to a bedding load set upon the upper surface of the box spring assembly 10. Each of the springs 12 is independently compressible downwardly in response to a downward deflection of the point on the grid 13 to which the upper end of the spring is attached.

Figure 2:
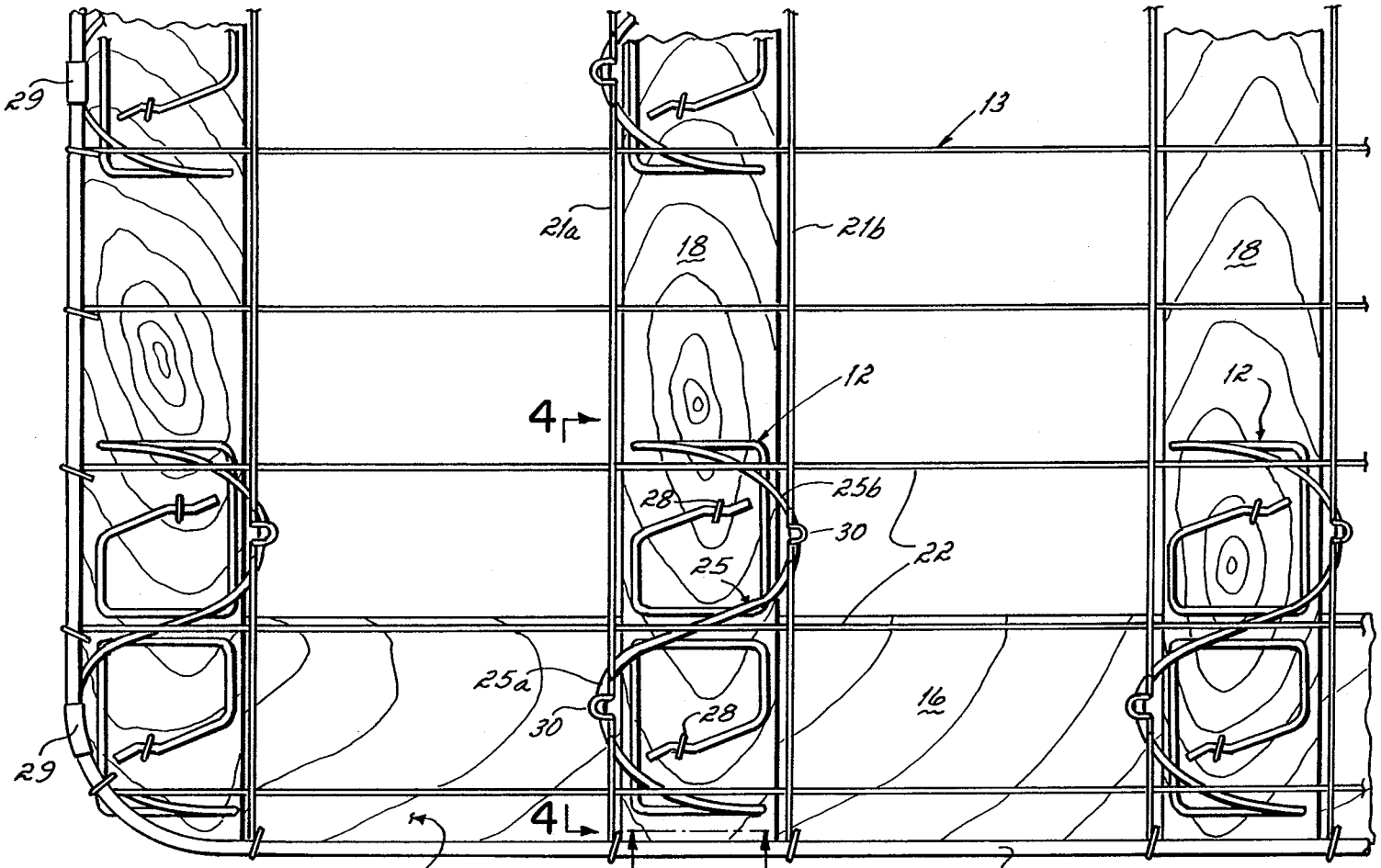
FIG. 2 is an enlarged top plan view of one corner of the box spring of FIG. 1.
Figure 3:
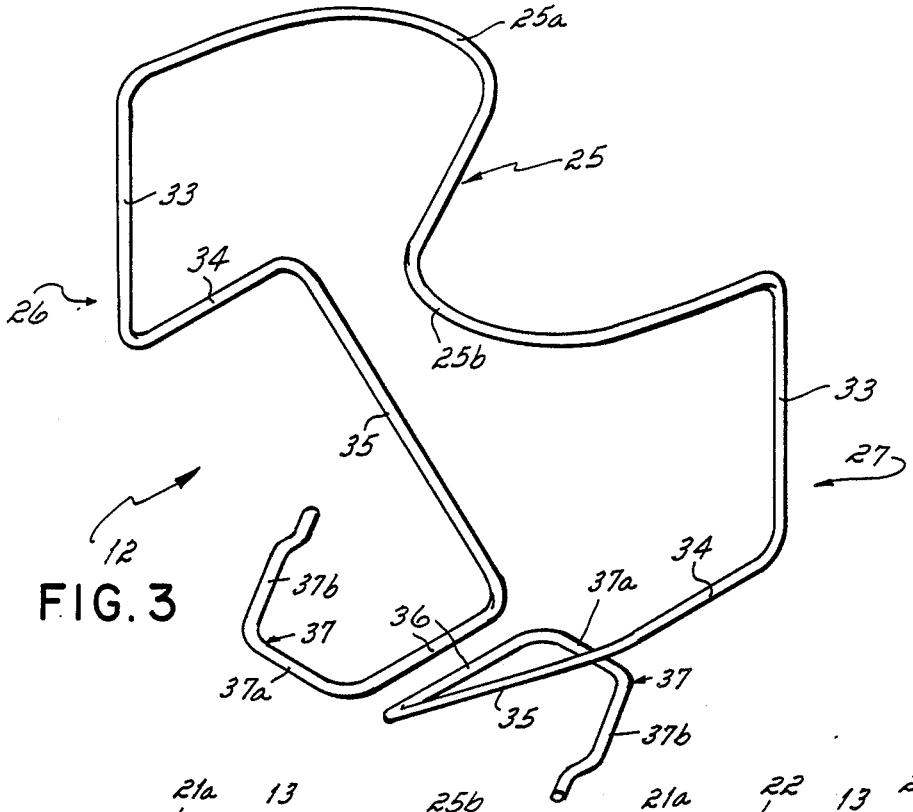
FIG. 3 is an enlarged perspective view of one spring element of the box spring of FIG. 1.

With reference to FIGS. 2 and 3 it will be seen that each of the springs 12 is a "formed," as opposed to a coil type, spring. Each spring has an upper horizontal load supporting portion 25 and a pair of yieldable end portions 26, 27 attached to opposite ends of the horizontal load supporting portion 25. The lower or bottom end of the yieldable end portions 26, 27 are attached as by staples 28 to the base frame, and the horizontal load supporting portion 25 is attached, as explained more fully hereinafter, to the welded wire grid.

The horizontal load supporting portion 25 of each spring comprises a pair of curvilinear sections 25*a*, 25*b* which are generally shaped as opposed semicircular sections formed into an S-shaped configuration. The S-shaped load supporting portion of the springs at the corners of the array are attached to the border wire 20 by means of metal clips 29 (FIGS. 1 and 2). Each spring is attached to a pair of transverse grid wires 21*a*, 21*b* by means of a pair of conventional hooks 30 formed in the transverse wires 21*a*, 21*b*. With reference to FIG. 2, it will be seen that opposite curvilinear sections 25*a*, 25*b* of each spring 13 is received in the hook fasteners 30 of the transverse wires 21*a*, 21*b* of the grid and that the transverse wires pass over the inside of the curvilinear sections of the springs so as to support the springs on opposite sides of the hook. It will also be noted with reference to FIG. 2 that the horizontal load supporting portions 25 of each spring engage three longitudinally extending wires 22 of the wire grid. Those longitudinally extending wires pass over the S-shaped horizontal load supporting portion of the springs, but are unsecured to the springs. Thereby, the springs 12 are entrapped beneath and within a pair of pockets of the array of pockets defined by the pairs of transversely extending wires 21*a*, 21*b* and three longitudinally extending wires 22 of the wire grid. Because curvilinear sections of the generally S-shaped horizontal load supporting portion are entrapped within the hook fasteners 30 formed in the transverse wires, there is no tendency for the load supporting portions of the springs to move within the hooks and thereby permit floating movement of the grid relative to the springs.

Figure 4:
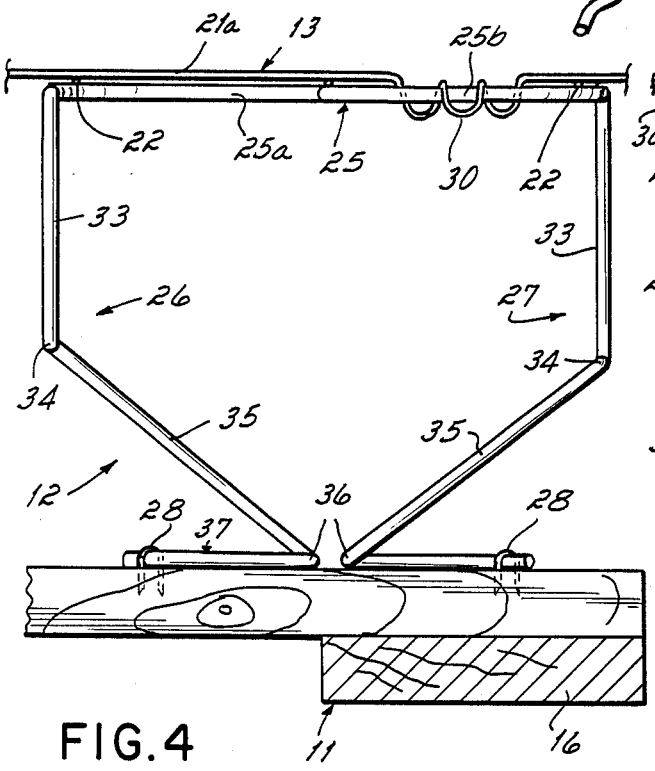
FIG. 4 is a cross-sectional view taken along lines 4—4 of FIG. 2.
Figure 5:
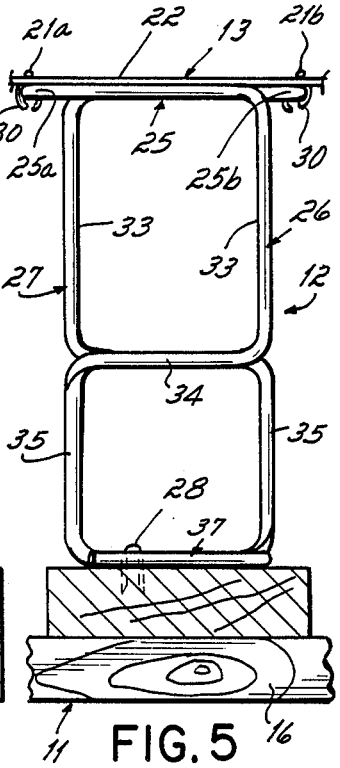
FIG. 5 is a cross-sectional view taken on line 5—5 of FIG. 2.

With reference now to FIGS. 3, 4 and 5, it will be seen that each of the formed wire springs 12 has a yieldable end portion 26, 27 extending downwardly from opposite ends of the horizontal load supporting portion 25 of the spring. Each of these yieldable end portions comprises a vertically extending post section 33, the lower end of which is connected to a horizontal torsion bar 34. The opposite end of this torsion bar 34 is connected to a downwardly and inwardly extending connecting bar 35, the bottom end of which is connected to a second horizontal torsion bar 36. The second horizontal torsion bar is connected at its opposite end to an outwardly turned, L-shaped foot 37. The second torsion bar 36 rests atop the frame, as does the outwardly extending, L-shaped foot 37 which is secured by staples 28 to the top of the frame. With reference to FIG. 4, it will be seen that the foot 37 and connecting bar 35 cooperate with the torsion bar 36 to form a "fishmouth" type compressible spring having an included angle of approximately 45 degrees formed thereby.

Again, with reference to FIG. 3, it will be seen that one vertical post section 33 at one end of the horizontal load supporting portion 25 of each spring is at the forward end of each spring, and the other vertically extending post section at the opposite end of the horizontal load supporting portion of the spring is at the rear end. Consequently, the spring is balanced in the sense that when a vertical load is applied to the spring, the spring compresses evenly and is not subject to twisting or turning as a consequence of a load applied thereto.

With reference to FIG. 1, it will be seen that five formed wire springs are located over the end boards 17 and the transverse slats 18 located adjacent to the end board 17, but that only four formed wire springs 12 are located over all of the other transverse slats 18 of the box spring. This distribution of the formed wire spring elements has been found to optimize the edge support of the box spring, while leaving the centermost portion of the box spring more resilient than the ends.

In order to manufacture the box spring of FIG. 1, the base frame assembly 11 is first preassembled. The spring elements 12 are then stapled to the base frame assembly, and a preassembled wire grid 13 then mounted over the load supporting portions 25 of the springs 12. After location of the welded wire grid 13 on the tops of the horizontal load supporting portions 25 of the springs, the hooks 30 of the transverse wires 21*a*, 21*b* of the grid are crimped shut so as to positively secure the grid to the springs. The structure and technique for forming these hooks 30 and for crimping them closed is fully disclosed in U.S. Pat. No. 3,577,574. Consequently, these hooks and the manner of crimping them shut has not been described in detail in this application.

After completion of the box spring assembly, the padding 14 is applied over the top of the box spring and the upholstery 15 then placed over the top of the padding and wrapped around the sides of the box spring assembly. The bottom edge of the upholstery is generally then stapled or otherwise fixed to the underside of the base frame assembly 11 so as to complete the manufacture of the box spring.

Figure 6:
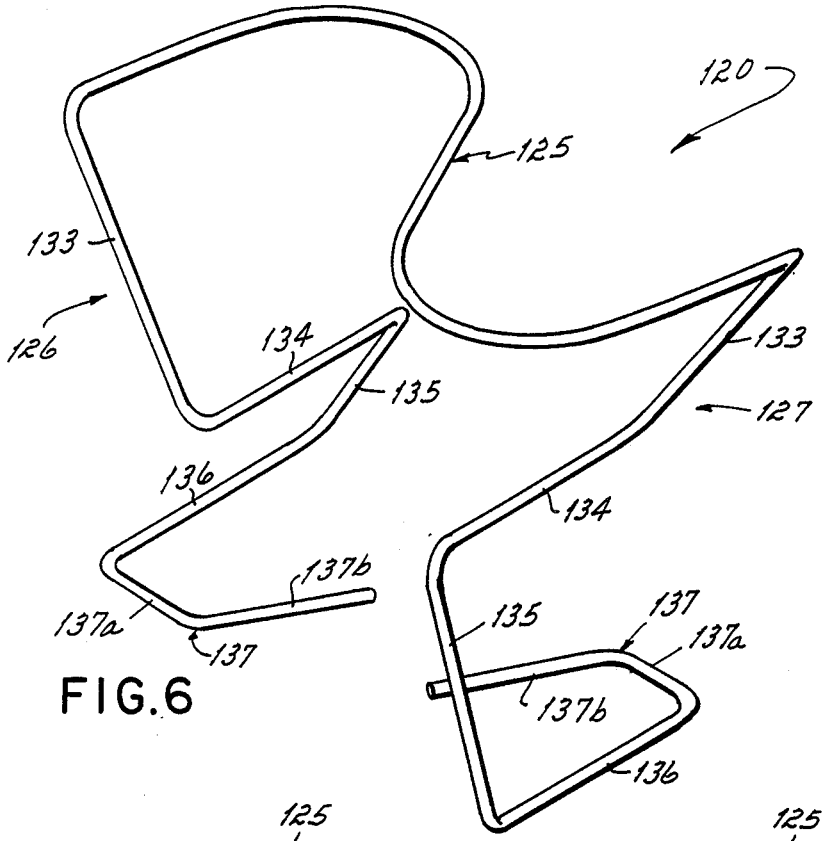
FIG. 6 is an enlarged perspective view of a second embodiment of formed wire spring which may be used in place of the formed wire springs of the box spring assembly in FIG. 1.
Figure 7:
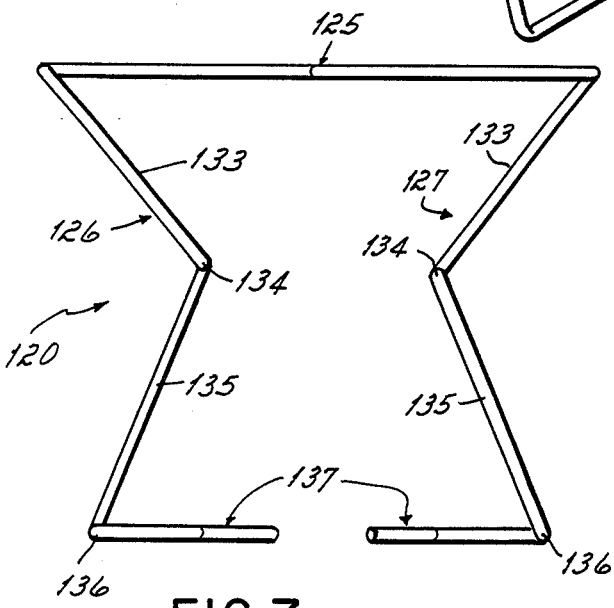
FIG. 7 is a front elevational view of the spring element of FIG. 6.
Figure 8:
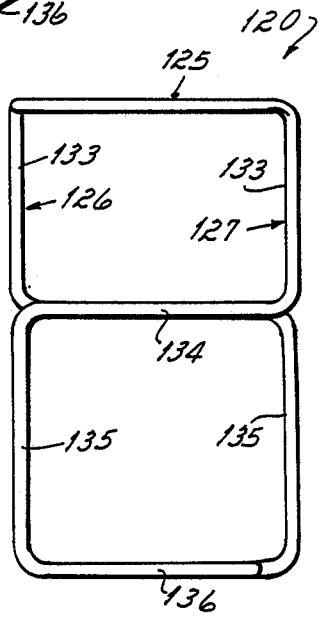
FIG. 8 is a side elevational view of the formed wire spring element of the FIG. 6.

With reference now to FIGS. 6, 7 and 8 there is illustrated another embodiment of the formed wire springs. These formed wire springs 120 of this second embodiment are identical in configuration to the springs 12, except for the yieldable end portions 126 and 127 of the springs. In other words, the horizontal load supporting portions 25 and 125 of the springs 12 and 120 are identical. Similarly, the foot portions 37 and 137 may be identical, although in this second embodiment the foot portion 137 is shown as being formed of two angled straight section 137*a*, 137*b* of wire, rather than one straight section 37*a* and a second straight section 37*b* having an offset end formed thereon. In this second embodiment 120 of the springs, the yieldable end portions 126, 127 of each spring comprises a connecting bar 133 which extends downwardly and inwardly from opposite ends of the S-shaped load supporting portion 125 of the spring. The lower ends of each of these connecting bars 133 are connected to one end of an upper torsion bar or first torsion bar 134, the opposite end of which is connected to a downwardly and outwardly extending connector bar 135. The opposite ends of these second or lower connecting bars 135 are connected to a second horizontal torsion bar 136 which rests atop the base frame assembly 11. The opposite ends of these lower torsion bars 136 are connected to a foot 137 of the spring. The foot of each yieldable end portion of the spring comprises a pair of generally L-shaped bars 137*a*, 137*b* which rest atop the base frame 137. With reference to FIG. 7, it will be seen that the two connector bars 133, 135 and torsion bar 134 of each of the yieldable end portions of the spring 120 forms a collapsible fishmouth spring section in each end portion of the spring.

It is to be noted that irrespective of which spring 12 or 120 is utilized in the box spring assembly, the welded wire grid is always connected to the horizontal load supporting portions 125 of the spring at a radiused curvilinear section of the spring. This is true whether the spring is connected to the wire grid by conventional sheet metal clips 29 or by hooks 30 formed in the wires of the grid. As a consequence of this connection of the curvilinear sections of the horizontal load supporting portions of the spring to the grid, there is no tendency for the springs to move or slide in the slips or hooks relative to the grid. Such sliding is a problem which is encountered whenever a straight section of the load supporting portion of a spring is attached to the grid.

It is to be noted that the spring modules of this invention eliminate the necessity for a differently configured spring at the corners of the spring assembly to connect a welded wire grid to a bottom frame of a box spring. Whenever formed wire springs having U- or rectangular-shaped load supporting portions of the spring are utilized for connecting the springs to the welded wire grid, there is generally a need for a differently radiused load supporting portion spring to be incorporated at the corners of the unit so as to conform the spring to the corner configuration. The S-shaped configuration of the load supporting portion of this spring has generally been found to eliminate that need for a differently configured spring at the corner.

Yet another advantage of the invention of this application and the S-shaped configuration of the horizontal load supporting portion of the spring is the adaptability of this spring to form modular springs having differing distances between the vertical legs without changing the quantity of wire in the spring. All that is required is to change the radius of the generally semicircular curvilinear sections 25*a*, 25*b*, and thereby the distance between the yieldable end portions of the spring may be varied to accommodate differing configurations of wire grids.

While we have described only two different embodiments of the invention, persons skilled in this art will appreciate other changes and modifications which may be made without departing from the spirit of our invention. Therefore, we do not intend to be limited except by the scope of the following appended claims.

I claim:

1. A bedding spring product comprising a horizontally disposed, generally rectangular frame, a plurality of formed wire springs mounted on said frame and extending upwardly therefrom, each of said springs comprising a unitary wire member having a generally horizontal load supporting portion and yieldable end portions depending from the ends of said load supporting portion, said yieldable end portions of said springs being supported upon said frame, a generally horizontal grid supported atop said horizontal load supporting portion of said springs, said grid being defined by a first plurality of spaced parallel wires and a second plurality of spaced parallel wires extending perpendicular to said first plurality of wires, said load supporting portion of each of said springs being formed from curvilinear sections formed into a generally S shape, said S-shaped load supporting portion having its opposite ends connected to said yieldable end portions of said spring, at least two of said first plurality of spaced parallel wires of said grid being secured to said curvilinear sections of each of said S-shaped load supporting portion of each of said springs, padding over the top of said grid, and an upholstered covering encasing said frame, wire springs, grid and padding.

2. A box spring assembly comprising a horizontally disposed, generally rectangular frame, a plurality of formed wire springs mounted on said frame and extending upwardly therefrom, each of said springs comprising a unitary wire member having a generally horizontal load supporting portion and yieldable end portions depending from the ends of said load supporting portion, said yieldable end portions of said springs being supported upon said frame, a generally horizontal grid supported atop said horizontal load supporting portion of said springs, said grid being defined by a first plurality of spaced parallel wires and a second plurality of spaced parallel wires and a second plurality of spaced parallel wires extending perpendicular to said first plurality of wires, said load supporting portion of each of said springs being formed from curvilinear sections formed into a generally S shape, said S-shaped load supporting portion having its opposite ends connected to said yieldable end portions of said spring, and at least two of said first plurality of spaced parallel wires of said grid being secured to said curvilinear sections of each of said S-shaped load supporting portion of each of said springs.

3. The box spring assembly of claim 2 wherein at least two of said second plurality of spaced parallel wires rest atop but are unsecured to said S-shaped load supporting portion of each spring.

4. The box spring assembly of claim 2 wherein at least three of said second plurality of spaced parallel wires rest atop but are unsecured to said S-shaped load supporting portion of each spring.

5. The box spring assembly of claim 2 wherein each of said end portions of each of said springs comprises a vertical post section, a pair of horizontal torsion bars, and at least one connecting bar, said vertical post section extending vertically downwardly from one end of said load supporting portion of one spring to one end of a first one of said horizontal torsion bars, said connecting bar extending downwardly and inwardly from the opposite end of said first one of said horizontal torsion bars to one end of the second of said pair of horizontal torsion bars.

6. The box spring assembly of claim 5 wherein said second one of said horizontal torsion bars rests atop said frame, and said second one of said pairs of horizontal torsion bars having an opposite end connected to a mounting foot.

7. The box spring assembly of claim 2 wherein each of said end portions of each of said springs comprises two vertically spaced, horizontal torsion bars and a pair of inclined connecting bars arranged in fishmouth formation, one of said connecting bars of each of said end portions extending downwardly and inwardly from one end of said load supporting portion to one end of the uppermost one of said two vertically spaced torsion bars, the other one of the pairs of connecting bars extending downwardly and outwardly from the opposite end of the uppermost one of the torsion bars to one end of the lowermost one of the two vertically spaced torsion bars, said lowermost one of the torsion bars being positioned on said frame and having a mounting foot connected to the opposite end thereof.

8. The box spring assembly of claim 2 wherein said spaced parallel wires of said grid are secured to said curvilinear sections of said S-shaped load supporting portions of said spring by hooks formed in said parallel wires.

9. A box spring assembly comprising a horizontally disposed, generally rectangular frame, a plurality of formed wire springs mounted on said frame and extending upwardly therefrom, each of said springs comprising a unitary wire member having a generally horizontal load supporting portion and yieldable end portions depending from the ends of said load supporting portion and supported from said frame, said load supporting portion of each of said springs being formed of curvilinear sections formed into a generally serpentine shape, said load supporting portions of each of said springs having opposite ends connected to said yieldable end portions of said spring, and a generally horizontal grid supported from said horizontal load supporting portion of said springs, said grid being defined by a first plurality of spaced parallel wires and a second plurality of spaced parallel wires extending perpendicular to said first plurality of wires, at least two of one of said plurality of spaced parallel wires being secured to said curvilinear sections of each of said load supporting portions of said springs.

10. The box spring assembly of claim 9 wherein at least two of said second plurality of spaced parallel wires rest atop but are unsecured to said serpentine-shaped, load supporting portion of each spring.

11. The box spring assembly of claim 9 wherein at least three of said second plurality of spaced parallel wires rest atop but are unsecured to said serpentine-shaped load supporting portion of each spring.

12. The box spring assembly of claim 9 wherein each of said end portions of each of said springs comprises a vertical post section, a pair of horizontal torsion bars, and at least one connecting bar, said vertical post section extending vertically downwardly from one end of said load supporting portion to one end of a first one of said horizontal torsion bars, said connecting bar extending downwardly and inwardly from the opposite end of said first one of said horizontal torsion bars to one end of the second of said pair of horizontal torsion bars.

13. The box spring assembly of claim 12 wherein said second one of said horizontal torsion bars rests atop said frame, and said second one of said pairs of horizontal torsion bars having an opposite end connected to a mounting foot.

14. The box spring assembly of claim 9 wherein each of said end portions of each of said springs comprises two vertically spaced torsion bars and a pair of inclined connecting bars arranged in fishmouth formation, one of said connecting bars of each of said end portions extending downwardly and inwardly from one end of said load supporting portion to one end of the uppermost one of said two vertically spaced torsion bars, the other one of the pairs of connecting bars extending downwardly and outwardly from the opposite end of the uppermost one of the torsion bars to one end of the lowermost one of the two vertically spaced torsion bars, said lowermost one of the torsion bars being positioned on said frame and having a mounting foot connected to the opposite end thereof.

15. The box spring assembly of claim 9 wherein said spaced parallel wires of said grid are secured to said curvilinear sections of said serpentine-shaped, load supporting portions of said springs by hooks formed in said parallel wires.

16. A box spring assembly comprising a horizontally disposed, generally rectangular frame, a plurality of formed wire springs mounted on said frame and extending upwardly therefrom, each of said springs comprising a unitary wire member having a generally horizontal load supporting portion and yieldable end portions depending from the ends of said load supporting portion, said yieldable end portions of said springs being supported upon said frame, a generally horizontal grid supported atop said horizontal load supporting portion of said springs, said grid being defined by a first plurality of spaced parallel wires and a second plurality of spaced parallel wires extending perpendicular to said first plurality of wires, said load supporting portion of each of said springs being formed from curvilinear sections formed into a generally S shape, said S-shaped load supporting portion having its opposite ends connected to said yieldable end portions of said spring, and at least two of said first plurality of spaced parallel wires of said grid being secured to said S-shaped load supporting portion of each of said springs.

17. The box spring assembly of claim 16 wherein at least two of said second plurality of spaced parallel wires rest atop said S-shaped load supporting portion of each spring.

18. A box spring assembly comprising a horizontally disposed, generally rectangular frame, a plurality of formed wire springs mounted on said frame and extending upwardly therefrom, each of said springs comprising a unitary wire member having a generally horizontal load supporting portion and yieldable end portions depending from the ends of said load supporting portion and supported from said frame, said load supporting portion of each of said springs being formed of curvilinear sections formed into a generally serpentine shape, said load supporting portions of each of said springs having opposite ends connected to said yieldable end portions of said spring, and a generally horizontal grid supported from said horizontal load supporting portion of said springs, said grid being defined by a first plurality of spaced parallel wires and a second plurality of spaced parallel wires extending perpendicular to said first plurality of wires, at least two of one of said plurality of spaced parallel wires being secured to said serpentine-shaped load supporting portions of said springs.

19. The box spring assembly of claim 18 wherein at least two of said second plurality of spaced parallel wires rest atop said serpentine-shaped, load supporting portion of each spring.

* * * * *